US006396417B2

(12) United States Patent
Lee

(10) Patent No.: US 6,396,417 B2
(45) Date of Patent: May 28, 2002

(54) SYSTEM FOR ASSISTING DRIVERS TO NEGOTIATE INTERSECTIONS

(75) Inventor: Jin-Dong Lee, Kyungki-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/751,298

(22) Filed: Dec. 29, 2000

(30) Foreign Application Priority Data

Jun. 8, 2000 (KR) ..... 00/31280

(51) Int. Cl.[7] ..... G08G 1/00

(52) U.S. Cl. ..... 340/904; 340/907; 340/915; 340/936; 340/988

(58) Field of Search ..... 340/904, 907, 340/909, 936, 991, 929, 915, 988

(56) References Cited

U.S. PATENT DOCUMENTS

| | | | | |
|---|---|---|---|---|
| 5,890,682 A | | 4/1999 | Welk | 246/125 |
| 5,926,113 A | | 7/1999 | Jones et al. | 340/906 |
| 5,955,968 A | * | 9/1999 | Bentrott et al. | 340/906 |
| 6,064,319 A | * | 5/2000 | Matta | 340/906 |
| 6,246,339 B1 | * | 6/2001 | Yamazaki | 340/904 |
| 6,292,109 B1 | * | 9/2001 | Murano et al. | 340/907 |

FOREIGN PATENT DOCUMENTS

| | | |
|---|---|---|
| DE | 29 51 769 | 7/1981 |
| DE | 196 01 024 | 7/1997 |
| DE | 198 42 912 | 3/2000 |
| EP | 0545437 A3 | 6/1993 |
| EP | 0545437 A2 | 6/1993 |
| EP | 0545437 | 6/1993 |
| JP | 08 128848 | 5/1996 |

OTHER PUBLICATIONS

EPO Search Report dated Sep. 10, 2001 for corresponding European patent application.

* cited by examiner

*Primary Examiner*—Daniel J. Wu
(74) *Attorney, Agent, or Firm*—Christie, Parker & Hale, LLP

(57) ABSTRACT

Disclosed is a system for assisting drivers to negotiate intersections comprising a wireless unit, which is mounted in a vehicle, for performing a wireless transmission and reception of various signals, and displaying various symbols to aid the driver in passing through an intersection; a bi-directional base station for receiving vehicle position signals from the wireless unit, then re-transmitting the vehicle position signals; a traffic light unit provided at an intersection or crosswalk, the traffic light unit displaying lights and signals; and an information service management center for receiving signals from the traffic light unit to determine an illumination state of the same, and transmitting the signals from the traffic light unit to the base station via a wire connection.

2 Claims, 3 Drawing Sheets

FIG. 3

| Signal | Normal speed | Increased speed | Reduced speed |
|---|---|---|---|
| Straight | | | |
| Left turn | | | |
| Straign/ Left turn | | | |

SYSTEM FOR ASSISTING DRIVERS TO NEGOTIATE INTERSECTIONS

CROSS-REFERENCE TO RELATED APPLICATION

This application claims priority of Korea patent Application No. 2000-31280, filed on Jun. 8, 2000.

BACKGROUND OF THE INVENTION (a) Field of the Invention

The present invention relates to a system for assisting drivers to negotiate intersections. More particularly, the present invention relates to a system for assisting drivers to negotiate intersections in which states of traffic lights at an upcoming intersection or crosswalk are anticipated and the driver is informed of which maneuvers are possible when reaching the intersection or crosswalk.

(b) Description of the Related Art

Drivers of vehicles must obey traffic lights set up at intersections and crosswalks. However, the changing of traffic lights from green to red is a frequent cause of confusion, sometimes resulting in accidents. That is, because of the duration of illumination of the yellow light varies from one traffic light to another, drivers may wrongly estimate the amount of time available to pass through an intersection before the traffic light turns red. In such instances, a driver may initially intend to traverse the intersection, then change his or her mind as the intersection is approached. Accordingly, the vehicle is abruptly stopped to avoid running a red light. This can result in a rear-end collision, especially when there is heavy traffic. The same situation may occur at traffic lights set up at crosswalks.

The potentially dangerous situation described above is worsened when vehicles are also able to make left turns at the intersection. That is, with any of the three different types of left turns, phasing- permissive, protected/permissive, and protected only- the confusion caused by the changing of signals from green to red is greatly increased at the intersection.

SUMMARY OF THE INVENTION

The present invention has been made in an effort to solve the above problems.

It is an object of the present invention to provide a system for assisting drivers negotiate intersections in which states of traffic lights at an upcoming intersection or crosswalk are anticipated and the driver is informed of which maneuvers are possible when reaching the intersection or crosswalk.

To achieve the above object, the present invention provides a system for assisting drivers negotiate intersections comprising a wireless unit, which is mounted in a vehicle, for performing a wireless transmission and reception of various signals, and displaying various symbols to aid the driver in passing through an intersection; a bi-directional base station for receiving vehicle position signals from the wireless unit, then retransmitting the vehicle position signals; a traffic light unit provided at an intersection or crosswalk, the traffic light unit displaying lights and signals; and an information service management center for receiving signals from the traffic light unit to determine an illumination state of the same, and transmitting the signals from the traffic light unit to the base station via a wire connection.

According to a feature of the present invention, the wireless unit comprises a ground positioning system (GPS) for detecting the vehicle position and transmitting the vehicle position signals; a vehicle speed sensor for detecting a present speed of the vehicle and outputting corresponding signals; a controller for receiving the vehicle speed signals output by the vehicle speed sensor, and receiving traffic signal information of the traffic light unit transmitted from the base station after passing through the information service management center, the traffic signal information including a present illumination state of the traffic light unit, a light change sequence, and a duration of illumination, after which the controller determines a distance to the intersection and an optimum symbol to aid the driver; and a display unit for displaying various symbols to aid the driver in passing through the intersection.

BRIEF DESCRIPTION OF THE DRAWINGS

The accompanying drawings, which are incorporated in and constitute a part of the specification, illustrate an embodiment of the invention, and, together with the description, serve to explain the principles of the invention:

FIG. 3 is an example of a display screen of a display unit of the system shown in FIG. 2.

DETAILED DESCRIPTION OF THE PREFERRED EMBODIMENTS

Preferred embodiments of the present invention will now be described in detail with reference to the accompanying drawings.

Figure 1:
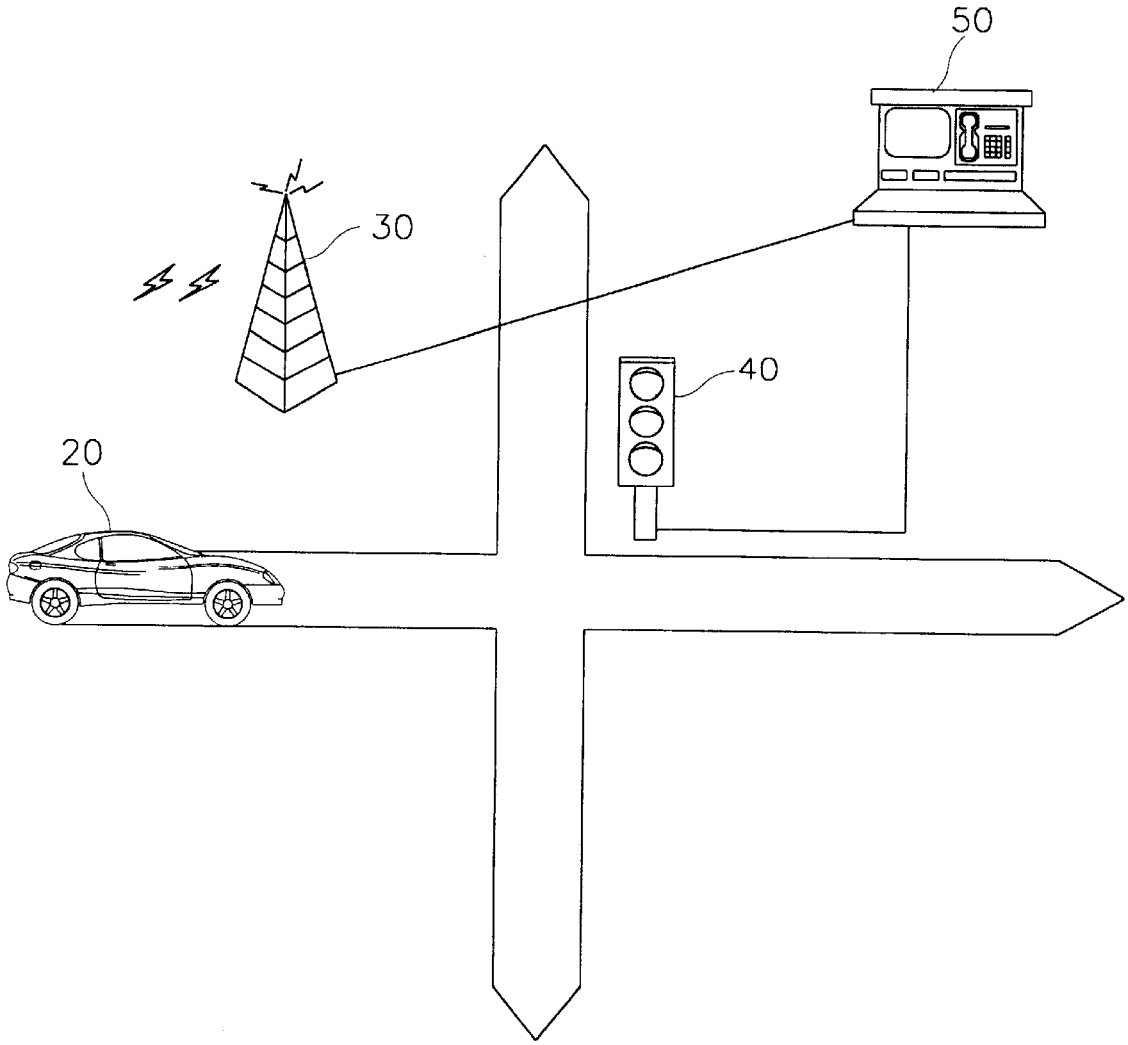
FIG. 1 is a schematic view of an intersection and elements involved in a system for assisting drivers negotiate intersections according to a preferred embodiment of the present invention.
Figure 2:
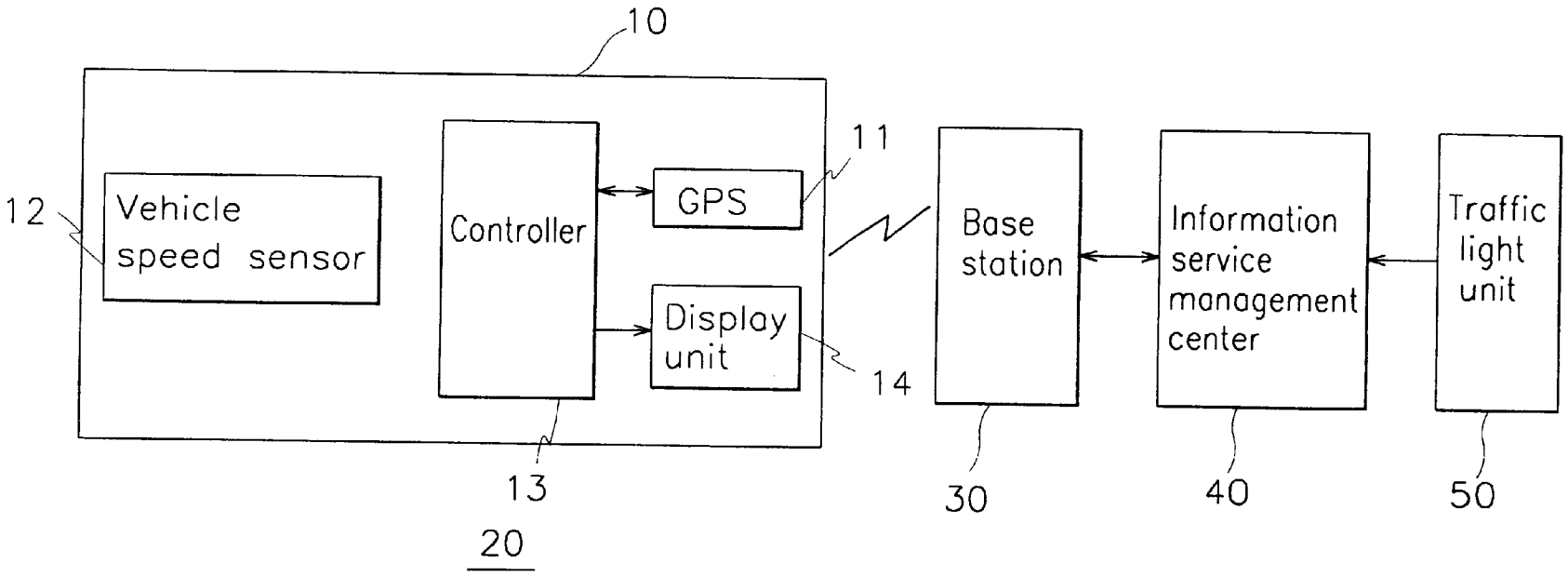
FIG. 2 is a block diagram of a system for assisting drivers negotiate intersections according to a preferred embodiment of the present invention.

FIG. 1 shows a schematic view of an intersection and elements involved in a system for assisting drivers negotiate intersections according to a preferred embodiment of the present invention; and FIG. 2 shows a block diagram of a system for assisting drivers negotiate intersections according to a preferred embodiment of the present invention.

Mounted in a vehicle 20 is a wireless unit 10 for performing the wireless transmission of vehicle position signals and wireless reception of other signals (to be described hereinafter), and for displaying various symbols to aid the driver in passing through an intersection. A bi-directional base station 30 receives the vehicle position signals from the wireless unit 10 of the vehicle 20, then re-transmits the vehicle position signals. A traffic light unit 40 is provided at an intersection or crosswalk, and displays lights and signals. Also, an information service management center 50 receives signals from the traffic light unit 40 to determine an illumination state of the same, then transmits this information to the base station 30 via a wire connection.

The wireless unit 10 of the vehicle 20 includes a ground positioning system (GPS) 11 for detecting the vehicle position and transmitting the vehicle position signals; a vehicle speed sensor 12 for detecting a present speed of the vehicle and outputting corresponding signals; a controller 13 for receiving the vehicle speed signals output by the vehicle speed sensor 12, and receiving traffic signal information of the traffic light unit 40 transmitted from the base station 30 after passing through the information service management center 50, the traffic signal information including a present illumination state of the traffic light unit 40, a light change sequence, and a duration of illumination, after which the controller 13 determines a distance to the intersection and an optimum symbol to aid the driver; and a display unit 14 for displaying various symbols to aid the driver in passing through the intersection.

FIG. 3 shows an example of a display screen of the display unit 14. As shown in the drawing, different symbols are illuminated to assist the driver in passing through the intersection. The symbols inform the driver whether it is safe to proceed through the intersection or make a left turn at the intersection at the present speed, at an increased speed, and at a reduced speed.

In more detail, as a traffic light at an intersection or crosswalk is approached, the wireless unit 10 transmits a wireless signal of the present vehicle position to the base station 30 via the GPS 11. Accordingly, the base station 30 transmits the signal of the vehicle position to the information service management center 50 through wires connecting the base station 30 to the information service management center 50. At the same time, the information service management center 50 receives from the traffic light unit 40 the present illumination state of the traffic light unit 40, the light change sequence, and the illumination duration of each signal of the traffic light unit 40. The information service management center 50 then transmits corresponding signals to the base station 30. Subsequently, the base station 30 transmits the signals to the GPS 11 of wireless unit 10 of the vehicle 20.

As a result, the signals received by the GPS 11 are supplied to the controller 13. The controller 13 receives signals of the present speed of the vehicle 20 from the vehicle speed sensor 12, then uses the vehicle speed signals to determine the remaining distance to the traffic light unit 40. Next, the controller 13 operates the display unit 14 to display the operations the driver may perform considering the remaining distance, present speed of the vehicle, and the anticipated state of the traffic light unit 40.

In the present invention structured and operating as in the above, by informing the driver in advance of reaching an intersection whether it is safe to proceed or not, drivers do not encounter confusion when negotiating intersections. Accordingly, the potential for accidents is greatly reduced.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A system for assisting drivers negotiate intersections comprising:

a wireless unit, which is mounted in a vehicle, for performing a wireless transmission and reception of various signals, and displaying various symbols to aid the driver in passing through an intersection;

a bi-directional base station for receiving vehicle position signals from the wireless unit, then re-transmitting the vehicle position signals;

a traffic light unit provided at an intersection or crosswalk, the traffic light unit displaying lights and signals; and an information service management center for receiving signals from the traffic light unit to determine an illumination state of the same, and transmitting the signals from the traffic light unit to the base station via a wire connection.

2. The system of claim 1 wherein the wireless unit comprises:

a ground positioning system (GPS) for detecting the vehicle position and transmitting the vehicle position signals;

a vehicle speed sensor for detecting a present speed of the vehicle and outputting corresponding signals;

a controller for receiving the vehicle speed signals output by the vehicle speed sensor, and receiving traffic signal information of the traffic light unit transmitted from the base station after passing through the information service management center, the traffic signal information including a present illumination state of the traffic light unit, a light change sequence, and a duration of illumination, after which the controller determines a distance to the intersection and an optimum symbol to aid the driver; and a display unit for displaying various symbols to aid the driver in passing through the intersection.

* * * * *